US006143098A

United States Patent [19]

Valtolina

[11] Patent Number: 6,143,098

[45] Date of Patent: Nov. 7, 2000

[54] PROCESS AND PLANT FOR THERMAL TREATMENT OF METALS IN PROTECTING ATMOSPHERE

[75] Inventor: Daniele Valtolina, Vigano' , Italy

[73] Assignee: Sol S.P.A., Italy

[21] Appl. No.: 09/102,509

[22] Filed: Jun. 22, 1998

[51] Int. Cl.[7] ..... C21D 1/00; C21D 1/76

[52] U.S. Cl. ..... 148/508; 148/633; 148/709; 148/712

[58] Field of Search ..... 148/508, 633, 148/712, 709; 518/715

[56] References Cited

U.S. PATENT DOCUMENTS

| | | | |
|---|---|---|---|
| 4,294,436 | 10/1981 | Takahashi | 266/257 |
| 5,322,676 | 6/1994 | Epting et al. | 23/351 |
| 5,348,592 | 9/1994 | Garg et al. | 148/208 |
| 5,401,339 | 3/1995 | Garg et al. | 148/629 |
| 5,779,826 | 7/1998 | Nayar et al. | 148/633 |

FOREIGN PATENT DOCUMENTS

| | | |
|---|---|---|
| 0 482 992 A1 | 4/1992 | European Pat. Off. . |
| 0 603 799 A3 | 6/1994 | European Pat. Off. . |
| 0 796 919 A1 | 9/1997 | European Pat. Off. . |
| 523144 | 7/1976 | U.S.S.R. . |
| 595295 | 7/1947 | United Kingdom . |
| 671421 | 5/1952 | United Kingdom . |

*Primary Examiner*—Sikyin Ip
*Attorney, Agent, or Firm*—Lerner, David, Littenberg, Krumholz & Mentlik, LLP

[57] ABSTRACT

A protective atmosphere for the heat-treatment of metals is obtained by heating a reactor containing a Nickel-based catalyst to a temperature of between 1000° C. and 1200° C., feeding to the reactor a flow of nitrogen having an oxygen content of between 0.1% and 9% and a flow of hydrocarbons that is substantially stoichiometric to the content of oxygen in the flow of nitrogen to obtain CO and $H_2$, and sending the gas from the catalytic reactor (2) to a heat-treatment furnace (1). The flow of hydrocarbons is interrupted periodically or by command while maintaining the flow of nitrogen, and is resumed after a preset or calculated time.

6 Claims, 1 Drawing Sheet

PROCESS AND PLANT FOR THERMAL TREATMENT OF METALS IN PROTECTING ATMOSPHERE

BACKGROUND OF THE INVENTION

Field of the Invention

The present invention relates to a process and plant for the heat-treatment of metals in a protective atmosphere, e.g. annealing, normalization, pre-tempra heating.

In these types of process, the atmosphere used in the furnace must be neutral, not carburizing or decarburizing, to avoid modification of the surface composition of the treated metal; the atmosphere could be slightly reductive to eliminate any oxygen which enters the heat treatment furnace.

Traditional heat treatment processes are known in which the protective atmosphere is produced by an exothermic generator in which a combustion reaction with a hydrocarbon takes place in a shortage of air, with comburant:fuel ratios (e.g. for methane) from 1:6 to 1:9. This process has the disadvantage of producing large quantities of $CO_2$ and $H_2O$ which must be at least in part removed from the mixture.

There are also known processes which use an endothermic generator to obtain the desired atmosphere from a mixture of air and hydrocarbons. The comburant:fuel ratio for reaction is 2:1 when methane is used. USSR application No. 523144, filed Mar. 27, 1975, discloses a method of preparing a protective atmosphere for metal treatment plants according to which commercial nitrogen, containing $O_2$ impurities, is mixed with natural gas in the amount of 2.0–2.5 volumes of of the oxygen present in the nitrogen. The mixture is fed to a reactor containing a Nickel catalyst, converted and fed to the furnace of the plant.

European Patent Application N°0482992, filed Oct. 22, 1991 in the name of AIR LIQUIDE, describes a process for obtaining a protective atmosphere with a low content of reducing agents by passing nitrogen with $O_2$ content of between 1% and 7% through a catalytic reactor provided with a precious metal catalyst at a temperature of between 400° C. and 900° C. On the one hand, this process has the advantage of producing an atmosphere with $H_2$ and CO contents in the same order as those of the exothermic reaction, but with low $CO_2$ and water contents; on the other, it requires the use of fairly expensive catalysts and is poorly suited to the treatment of high- to medium-carbon steels.

This document also mentions the possibility of operating at high temperatures with a Nickel-based catalyst, as disclosed by the USSR application above discussed, but judges such a process unsuitable for industrial production and advises against its use.

OBJECTS OF THE INVENTION

The aim of the present invention is to overcome the aforementioned problems and provide a process and a plant for heat treatment in a protective atmosphere which is inexpensive, industrially applicable, has a controllable content of CO and $H_2$ and very low $CO_2$ contents.

SUMMARY OF THE INVENTION

The present invention relates to a process for the heat treatment of metals in a protective atmosphere comprising heating a reactor containing a nickel-based catalyst to a temperature within the range of about 1000° C. to about 1200° C., feeding the reactor with a flow of nitrogen containing from 0.1% to 9% oxygen, feeding the reactor with a flow of hydrocarbons in an amount substantially stoichiometric with the content of oxygen to give CO and hydrogen, feeding the gas leaving the catalytic reactor to a heat-treatment furnace to provide a protective atmosphere inside the furnace, interrupting periodically or by command the flow of hydrocarbons while maintaining the flow of nitrogen containing oxygen, and resuming the hydrocarbon flow to the catalytic reactor after a preset or calculated time.

The invention also relates to a plant for the heat treatment of metals comprising a heat treatment furnace, a catalytic reactor containing a nickel-based catalyst, a source of nitrogen having an oxygen content within the range of 0.1% to 9% duct means for feeding the reactor with a flow of the nitrogen having an oxygen content within the range of 0.1% to 9%, a source of hydrocarbons, duct means for feeding the reactor with a flow of the hydrocarbons, valve means for regulating and interrupting the flow of hydrocarbons from the source of hydrocarbons to the reactor, and control means to operate the valve means periodically or by command for interrupting the flow of hydrocarbons to the reactor while maintaining the flow of hydrogen containing oxygen, and to resume the flow of hydrocarbons to the reactor after a preset or calculated time.

According to preferred aspect of the invention, during the interruption of the flow of hydrocarbons, the oxygen content of the nitrogen is maintained between 3% and 5%.

According to another preferred aspect of the invention, the CO, hydrocarbon and $CO_2$ contents of the gas leaving the catalytic reactor are detected; a corresponding signal is generated and compared with ma previously memorized value in a computer to regulate the rate and composition of the gas flow entering the catalytic reactor.

The process according to the invention has several advantages over the present state of the art.

The process according to the invention allows to obtain a protective atmosphere with reducing agent ($H_2$ and CO) content generally from 10% to 20%, similar to what can be obtained with an exothermic process, and with very reduced water and $CO_2$ contents. In this way, both the problems of lowering the water and $CO_2$ contents and the problems related to high content of carburizing substances which are typical of the exothermic process are solved. Furthermore, the oxidation reaction in the catalytic reactor can be controlled to give an atmosphere in which the $CO_2$ content is in equilibrium with the carbon content of the metal being treated: also medium- to high-carbon content metals can thus be heat-treated.

A further important advantage is that the process according to the present invention does not require the traditional regeneration of the catalyst, which usually requires shutdown of the plant for all the time necessary to its completion.

Another advantage is that the process allows copper and its alloys to be treated in bell furnaces.

BRIEF DESCRIPTION OF THE DRAWING

The invention will now be described in more detail with reference to the enclosed drawing which is by way of example and is not limiting, which shows a schematic embodiment of the plant according to the invention.

DESCRIPTION OF THE PREFERRED EMBODIMENTS

Figure 1:
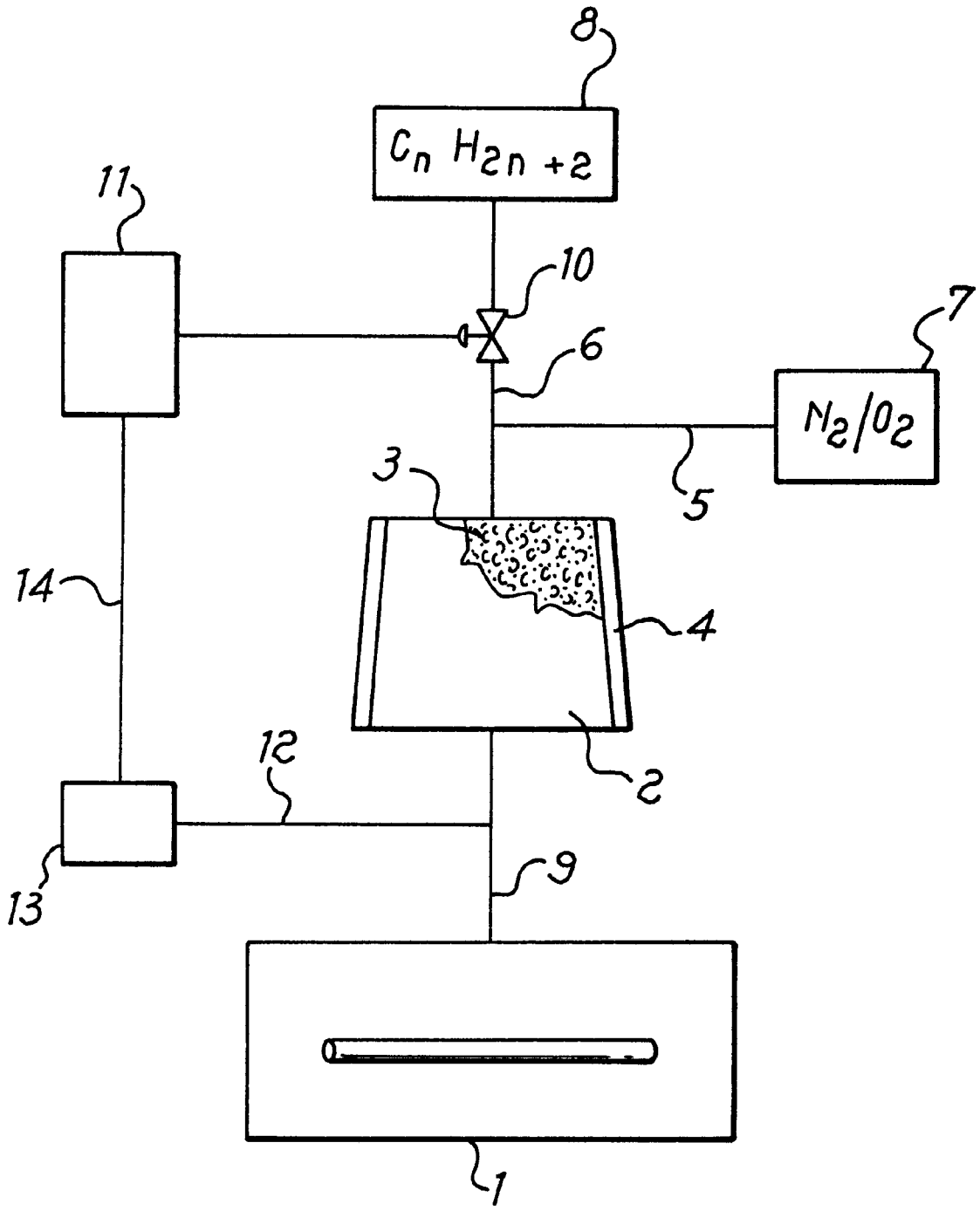

The plant of the invention comprises a furnace 1 for the heat-treatment of metal products, usually made of steel, copper and its alloys in a protective atmosphere. Upflow of furnace 1 there is reactor 2, in which the required atmosphere is generated. Reactor 2 contains a Nickel-based catalyst 3 (e.g. of the type consisting of 6–7% of Nickel on alumina) and comprises a means 4 of heating it to a temperature of from 1000 to 1200° C. Heating means 4 are known per se in the art. Two ducts 5 and 6 connect reactor 2 to a source 7 of nitrogen containing a controlled and known amount of oxygen, and to a hydrocarbon source 8, respectively. The source of nitrogen with oxygen mixed in is of a type known to the art and is such as to provide a mixture whose $O_2$ content is between 0.1% and 9.0%, preferably from 1% to 5% (by volume). A duct 9 feeds the gas resulting from reaction in reactor 2 to furnace 1.

On duct 6 there is provided a valve 10 or similar means of regulating or interrupting the flow of hydrocarbons to the reactor 2. Valve means 10 is controlled by a computer 11, which comprises both a means of processing data and recording it. The computer 11 is linked by line 14 to a means of analysis 13, which is connected to duct 9 by line 12. Analyser 13 can detect the content of CO, hydrocarbon and $CO_2$ in the effluent gas from reactor 2.

The plant according to the invention operates in the following manner.

A value is set for the percentage of oxygen in the nitrogen flow feeding the reactor 2; as mentioned above, the $N_2$—$O_2$ mixture comprises from 0.1% to 9.0%, preferably from 1% to 5% (by volume). Such a mixture is obtained by techniques known to the art, e.g. by absorption or permeation. The hydrocarbon flow is regulated so as to feed the reactor 2 a quantity of hydrocarbons substantially stoichiometrical with respect to the oxygen content to produce CO and $H_2$. The desired reaction is shown below using methane (1) and propane (2) as hydrocarbon, by way of example:

$$(100-x)N_2+xO_2+2xCH_4 \rightarrow (100-x)N_2+2xCO+4xH_2 \quad (1)$$

$$(100-x)N_2+xO_2+\tfrac{3}{2}xC_3H_8 \rightarrow (100-x)N_2+2xCO+\tfrac{8}{2}xH_2 \quad (2)$$

The reactor 2 is maintained at a temperature within the range of 1000° C. to 1200° C., preferably between 1050° C. and 1100° C. The atmosphere thus obtained is fed to furnace 1.

As specified above, the hydrocarbon flow is regulated by means of valve 10 to give the desired composition for the protective atmosphere. For example, analyzing the gas leaving the reactor by means of analyzer 13 (known per se to the art) and measuring the $CO_2$ content, the reaction can be controlled to have a $CO_2$ content in equilibrium with the carbon content of the steel present in the heat-treatment furnace.

Valve means 10 also interrupt the hydrocarbon flow to reactor 2 periodically and/or by command, while continuing to feed the nitrogen/oxygen flow to reactor 2. The $O_2$ content of the nitrogen flow fed to the reactor while the hydrocarbon flow is interrupted is usually less than 10% and is preferably within the range of 3% to 5%. Therefore, if the $O_2$ content of the nitrogen flow used at the same time as the hydrocarbon flow is within this range, this same $N_2/O_2$ flow can be used during the said periods of interruption of the hydrocarbon flow. If the initial $O_2$ content is less, then it is preferably raised to the desired value. These interruptions are controlled by the computer 11 according to two distinct modes which can, however, be combined.

The interruptions can be pre-programmed and actuated periodically according to a program run on computer 11 which regulates their frequency and length based on pre-set data. As an alternative or in addition to the above, the interruptions could be triggered by a situation of incorrect operation of reactor 2 being detected. In this case analyser 13 measures the quantity of hydrocarbon in the gas leaving the reactor, generates a signal corresponding to the value of said detected content and sends it to the means of processing data in computer 11. Here the values detected are compared to the values memorized in the computer which can—if necessary—interrupt the flow of hydrocarbons to reactor 2.

The length of each interruption can be pre-set (generally from 1 to 60 seconds) or linked to the values of CO and $CO_2$ detected in the gas leaving the reactor 2. In the latter case, the analyser detects the content of said compounds in the gas leaving the reactor and the computer keeps valve 10 closed until the CO and $CO_2$ levels are below a pre-set threshold.

As mentioned above, interrupting the flow as described above avoids the problem of having to regenerate the catalyst in the traditional way, that provides for the plant to be shut down for not less than 12 hours once or twice a month. Without giving a complete scientific explanation of the phenomenon, it is believed that flushing with the $N_2/O_2$ flow alone for short periods is sufficient to oxidize and remove carbon accumulations on the catalyst, without greatly varying the other operating parameters of the same.

The invention will be further described with reference to the following examples.

EXAMPLE 1

Normalization of medium-high carbon steel pipes

A flow of $N_2$ containing 3% (by vol.) $O_2$ and a flow of methane were fed into a catalytic reactor containing a Ni-based (7% on alumina) catalyst. The reactor was heated to 1050° C.

The atmosphere generated by the reactor (which contained 6% of CO and 12% of $H_2$) was sent to the normalization furnace, heated to 900° C. The supply of methane was interrupted periodically for short periods during the production of the atmosphere.

The treated pipes had a bright surface, without chemical alteration of the surface.

EXAMPLE 2

Treatment of coirer products

A flow of $N_2$ containing 2% of $O_2$ and a flow of methane gas was sent to a reactor according to Example 1.

The atmosphere generated by the reactor comprised about 4% of CO and 8% of $H_2$ and was sent to a bell furnace heated at about 600° C. The products treated had a very bright surface without any surface oxidation.

What is claimed is:

1. A process for the heat-treatment of metals in a protective atmosphere, comprising the following steps:

heating a reactor containing a Nickel-based catalyst to a temperature within the range of about 1000° C. to about 1200° C.;

feeding said reactor with a flow of nitrogen containing from 0.1 to 9% oxygen;

feeding said reactor with a flow of hydrocarbons in an amount substantially stoichiometric with said content of oxygen to give CO and hydrogen;

feeding the gas leaving said catalytic reactor to a heat-treatment furnace to provide a protective atmosphere inside said furnace;

interrupting periodically or by command said flow of hydrocarbons, while maintaining said flow of nitrogen containing oxygen, and resuming said hydrocarbons flow to the catalytic reactor after a pre-set or calculated time.

2. A process according to claim 1, wherein the oxygen content of the nitrogen flow is varied during the interruption of the flow of hydrocarbons.

3. A process according to claim 1 or 2, wherein the oxygen content of the nitrogen flow is within the range of 3% to 5% during the interruption of the flow of hydrocarbons.

4. A process according to claim 1, wherein said catalytic reactor is heated to a temperature of between 1050° C. and 1100° C.

5. A process according to claim 4, wherein the oxygen content of the said nitrogen flow is within the range of 1% to 5%.

6. A process according to claim 1, further comprising the following steps: detecting the content of CO, hydrocarbons and/or $CO_2$ in the gas leaving said catalytic reactor; generating a signal corresponding to the value of said content of CO, hydrocarbon and/or $CO_2$ and sending that signal to a means of data-processing the said signal; comparing the value corresponding to the said signal with values memorized in the said means of data-processing; regulating the flow of hydrocarbons and/or the oxygen content of the said nitrogen flow as a function of said memorized values.

* * * * *

UNITED STATES PATENT AND TRADEMARK OFFICE

CERTIFICATE OF CORRECTION

PATENT NO. : 6,143,098

DATED : November 7, 2000

INVENTOR(S) : Valtolina

It is certified that error appears in the above-identified patent and that said Letters Patent is hereby corrected as shown below:

On the face of the patent, at [75], "Vigano'" should read --Vigano (LC)--.

On the face of the patent, insert:

--[30] Foreign Application Priority Data

Mar. 20, 1996 [EP] Europe . . . . . 96830133.3--.

Column 1, line 27, "USSR" should begin a new paragraph.

Column 2, line 13, after "9%" insert --,--.

Column 2, line 67, "Upflow" should begin a new paragraph.

Column 4, line 40, "coirer" should read --copper--.

Signed and Sealed this

First Day of May, 2001

*Attest:*

Nicholas P. Godici

NICHOLAS P. GODICI

*Attesting Officer*

*Acting Director of the United States Patent and Trademark Office*